US005198612A

United States Patent [19]

Myers

[11] Patent Number: 5,198,612

[45] Date of Patent: Mar. 30, 1993

[54] IN-FLIGHT ELECTRONIC COUNTERMEASURE PAYLOAD SIMULATOR

[75] Inventor: Thomas R. Myers, Austin, Tex.

[73] Assignee: Tracor Aerospace, Inc., Austin, Tex.

[21] Appl. No.: 684,996

[22] Filed: Apr. 15, 1991

[51] Int. Cl.[5] ..... F42C 21/00

[52] U.S. Cl. ..... 102/293

[58] Field of Search ..... 102/293, 505; 342/14; 73/167

[56] References Cited

U.S. PATENT DOCUMENTS 4,969,819 11/1990 James ..... 434/5

5,050,501 9/1991 Barditch et al. ..... 102/293

OTHER PUBLICATIONS

John Antonacos, ALM-177 Supplemental Test Set (STS).

Critical Item Development Specification for the Smart Breech Plate Adapter-First Line Tester.

*Primary Examiner*—Charles T. Jordan

*Attorney, Agent, or Firm*—Arnold, White & Durkee

[57] ABSTRACT

An electronic countermeasure (ECM) simulator which fits into the housing of any actual ECM payload device and substitutes electrical components for the chaff, flares or other countermeasures which are emitted into the environment. The ECM payload simulator electrically verifies firing ability for any ECM dispensing system using a magnetic indicator which sets when the electrical signal required to fire an actual ECM payload device operates properly. The magnetic indicator can be viewed, tested and reset by a ground crew upon return of the aircraft to ground. The magnetic indicator has a parallel resistor so that the aircraft's arsenal inventorying device will indicate an unfired ECM payload device. An optional radio frequency (RF) transmitter may be substituted for the magnetic indicator to send coded transmissions to a radar site while in flight. Additionally, an electrical circuit may be added to measure amplitude and duration of the electrical firing signal and to prevent feedback into the ECM dispensing system. The ECM payload simulator can simulate both a single payload and dual payload ECM payload device. Filler material such as flexane TM may be is added to the simulator housing to make the weight of the simulator equal to an actual ECM payload device.

18 Claims, 6 Drawing Sheets

IN-FLIGHT ELECTRONIC COUNTERMEASURE PAYLOAD SIMULATOR

BACKGROUND OF THE INVENTION

1. Field of the Invention

The present invention relates broadly to airborne electronic countermeasure (ECM) dispensing systems. The invention more particularly concerns an in-flight system for testing such ECM dispensing systems. The invention especially relates to an airborne simulator for testing in-flight the ability of an ECM dispensing system to generate a proper signal to actuate an ECM payload device.

2. Description of the Related Art

Military aircraft commonly employ electronic countermeasure systems which defeat systems that detect and home in on the aircraft. The ECM dispensing systems use sensors which sense the energy of the detection and homing mechanisms. The ECM dispensing systems are attached to ECM payload device cartridges which dispense countermeasures in response to firing signals generated by the ECM dispensing system. The cartridges may carry chaff, flares, RF generators, infrared generators, or the like.

It is important, of course, to know that the firing signal patterns generated by the sensors of an ECM dispensing system are functionally correct and adequate to activate an ECM payload device. In the past, knowledge of properly generated firing signals has been obtained only when the aircraft bearing the ECM dispensing system is on the ground. No way has ever existed which tests the ECM dispensing system in-flight without actually discharging contents of the ECM payload device cartridges into the air. A ground testing set is available to verify firing signal parameters such as voltage amplitude and duration which are emitted by ECM dispensing systems when they are activated. These ground test sets, however, are designed and are applicable only for use on the ground.

Aircraft generally carry a plurality of ECM payload devices whose cartridges are arranged in one or more batteries or magazines mounted on the aircraft. Some ECM dispensing systems also emit a low voltage signal used to inventory the cartridges to determine how many of the devices are available for use. If an active cartridge is not present, the inventory process indicates an open circuit. The ground test sets for testing ECM dispensing systems, mentioned above, are also capable of testing the ability of the ECM dispensing systems to carry out such inventory processing.

ECM dispensing systems currently employed in military aircraft include ECM dispensing systems identified as the M130, ALE-40 and ALE-45 countermeasure dispensing sets. A ground test set currently used to ground test these ECM dispensing systems is known as the ALM-177 Supplemental Test Set (STS).

ECM dispensing systems such as the M130, ALE-40 and ALE-45 has firing pulses with preselected durations and amplitudes. An ECM dispensing system such as the ALE-45 typically delivers a firing pulse of 4.25 volts direct current (VDC) for approximately 22 milliseconds. Pulse durations and amplitudes may vary somewhat, but minimum values are generally about 15 ms and 4.1 VDC. The STS testing set indicates a pass or fail condition concerning these values on LED displays.

The ECM dispensing systems may also deliver pulses of two different amplitudes used to fire two separate countermeasure devices or payloads. For a two payload activating ECM payload device, the ALE-45 delivers a first pulse with an amplitude of about 5 volts DC, and a second pulse with an amplitude of about 12 volts DC.

ALE-45 inventories are conducted by sending a low power current to each ECM payload device. A resistance of five ohms or less indicates an unfired payload, which is then included in the inventory of available payloads.

As noted earlier, current ECM dispensing systems such as the ALE-45 cannot be activated while weight is on the wheels of the aircraft carrying the devices. An override switch enables the ECM dispensing systems to be tested by the STS, while weight is on the wheels.

SUMMARY OF THE INVENTION

The present invention in a general aspect includes an ECM payload simulator for testing the ability of an ECM dispensing system to function properly on an aircraft, while the aircraft is in the air. The ECM payload simulator replaces a conventional loaded ECM payload device, thereby eliminating the release of any explosives, chaff or the like into the air. The ECM payload simulator, moreover, enables in-flight tests during normal flight paths and maneuvers. The testing system may provide a record of a firing directly on the aircraft or transmit a signal to a ground or other remote location. The invention models actual ECM payload devices in their physical dimensions and weight, and thereby reduces possible adverse or indeterminate effects on aircraft performance. The devices of the invention may also be assembled in magazines or the like, thereby further simulating actual ECM payload magazine inventories.

Thus the present invention is an ECM payload simulator which fits into the housing of any actual ECM payload device and substitutes electrical components for the chaff, flares or other countermeasures which are emitted into the environment. The ECM payload simulator electrically verifies firing ability for any ECM dispensing system by using a magnetic indicator which sets when the electrical signal required to fire an actual ECM payload device operates properly. The magnetic indicator can be viewed, tested and reset by a ground crew upon return of the aircraft to ground. The magnetic indicator has a parallel resistor so that the aircraft's arsenal inventorying device will indicate an unfired ECM payload device. An optional radio frequency (RF) transmitter may be used along with the magnetic indicator to send coded transmissions to a radar site while in flight. Additionally, an electrical circuit may be added to measure amplitude and duration of the electrical firing signal and to prevent feedback into the ECM dispensing system. The ECM payload simulator can simulate both a single payload and dual payload ECM payload device. Filler material such as Flexane TM may be added to the simulator housing to make the weight of the simulator equal to an actual ECM payload device.

BRIEF DESCRIPTION OF THE DRAWINGS

Further details of the present invention are explained with the help of the attached drawings in which.

DESCRIPTION OF THE PREFERRED EMBODIMENTS

Figure 1:
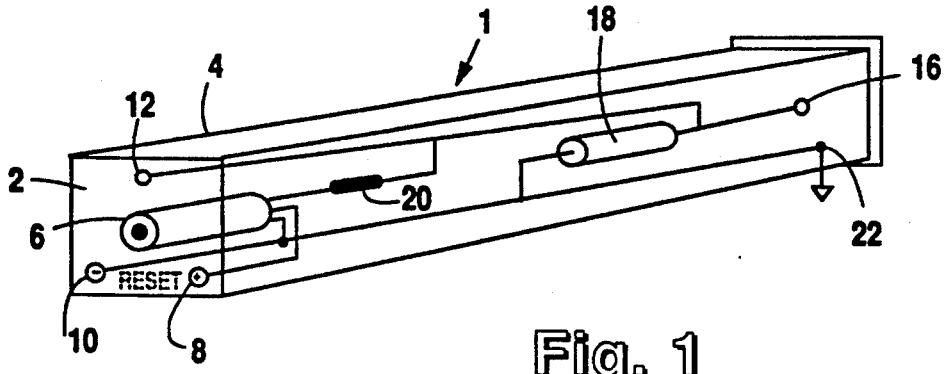
FIG. 1 shows a single payload version of the ECM payload simulator of the present invention.
Figure 2:
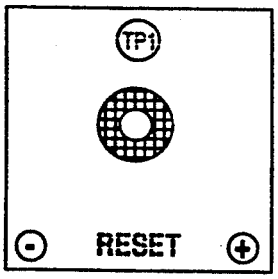
FIG. 2 shows a front view of the cartridge end cap shown in FIG. 1.

FIG. 1 shows a single payload version of an electronic countermeasure simulator (ECM payload simulator) of the present invention. The single payload ECM payload simulator 1 comprises electronic components necessary to indicate accurate operation of an ECM dispensing system such as the ALE-45. The single payload ECM payload simulator 1 has a housing 4 which may be an empty cartridge typically used for actual ECM payload devices. Thus, the ECM payload simulator housing may comprise a liner cartridge 4 such as Tracor's 1 in.×1 in.×8 in. TPN 130076-0002 liner cartridge. The simulator housing also includes a cartridge end cap 2 which serves to seal the liner cartridge 4. Various cartridge end caps may be used such as the Tracor 137144-001 cartridge end cap. FIG. 2 shows a front view of the Tracor 137144-001 cartridge end cap.

An opening in the liner cartridge enables viewing a magnetic indicator 6. The magnetic indicator 6 is selected to turn color, when the firing pin 16 and ground spring 22 in an inert squib 14 conduct an electrical firing signal for a minimum duration and minimum voltage level to fire an actual ECM payload device. If the simulator fails to operate properly because of a faulty signal or other reason, the magnetic indicator 6 remains its original color. A typical magnetic indicator is the Minelco model BHGD21T-3-W/BLK, which changes from black to white in response to proper firing signals.

Figure 3:
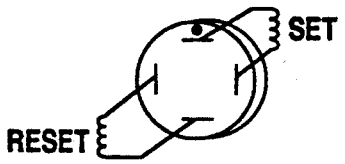
FIG. 3 shows a rear view of the magnetic indicator.

The Minelco indicator may be reset by applying a lower DC voltage signal to its terminals. Two additional openings in the liner cartridge enable resetting of the magnetic indicator 6. A ground crew can reset a Minelco magnetic indicator by either applying a 3 volt direct current (VDC) signal to the positive and negative 3 VDC contact points 8 and 10 using two series connected flashlight batteries for a 3 VDC source, or by passing a small magnet of the correct polarization over the face of the magnetic indicator. Either of the two operations will reset the indicators to the black color. FIG. 3 shows a rear view of the Minelco magnetic indicator with the set and reset connections.

Another opening in the liner cartridge enables ground crews to test the firing pin 16 through fire pin test point 12. The fire pin test point 12 also enables the ground crew to test the magnetic indicator 6.

Figure 4:
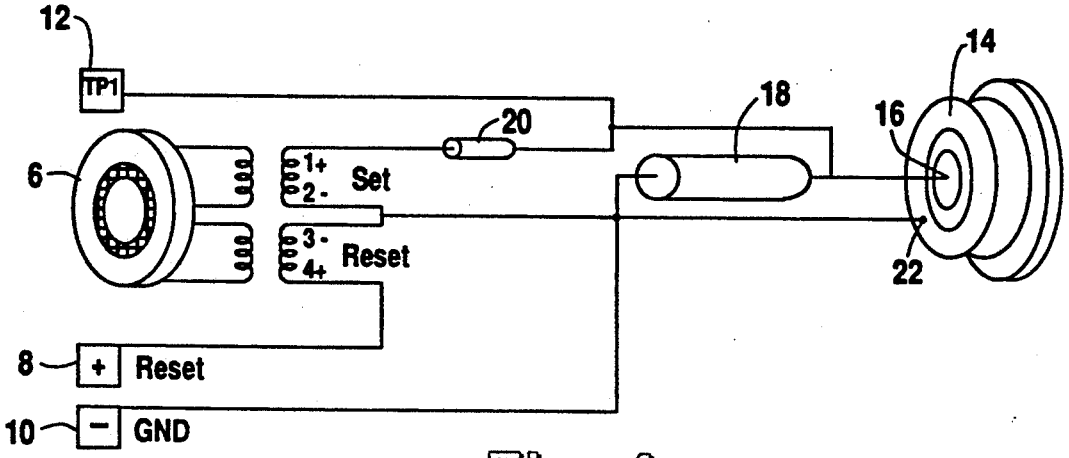
FIG. 4 shows a more detailed circuit diagram for the electrical component contained in the single payload ECM payload simulator of FIG. 1.

FIG. 4 shows a more detailed circuit diagram for the electrical components contained in the single payload ECM payload simulator of FIG. 1. The firing pin 16 extends through the cartridge end cap 2 and into the inert squib 14. A typical inert squib is the Tracor TPN 130076-0002. The magnetic indicator 6 has a set circuit connected on one side through a threshold adjusting resistor 20 to the firing pin 16 and on the other side to ground spring 22 which also extends through the inert squib 14.

Some ECM dispensing systems are capable of inventorying the number of available ECM payload devices on an aircraft. These systems make use of impedances connected from the firing pin 16 to ground spring 22, wherein the impedances are low relative to firing circuits and are generally less than 5 ohms. The impedance, when observed, is added to the inventory table. As an example, the ALM-177 STS uses a 1 ohm resistor to test the ALM-45's ability to inventory its arsenal, and the ECM payload simulator in that instance must also have a comparable resistance. Thus, the simulator of the present invention would also typically employ a 1 ohm, 1%, 20 watt resistor 18 such as manufacturer number RER70FIR00R RCL20W 24583-1R00. The 1 ohm resistor 18 is connected from the firing pin 16 to the ground spring 22 in parallel with magnetic indicator 6.

Figure 5:
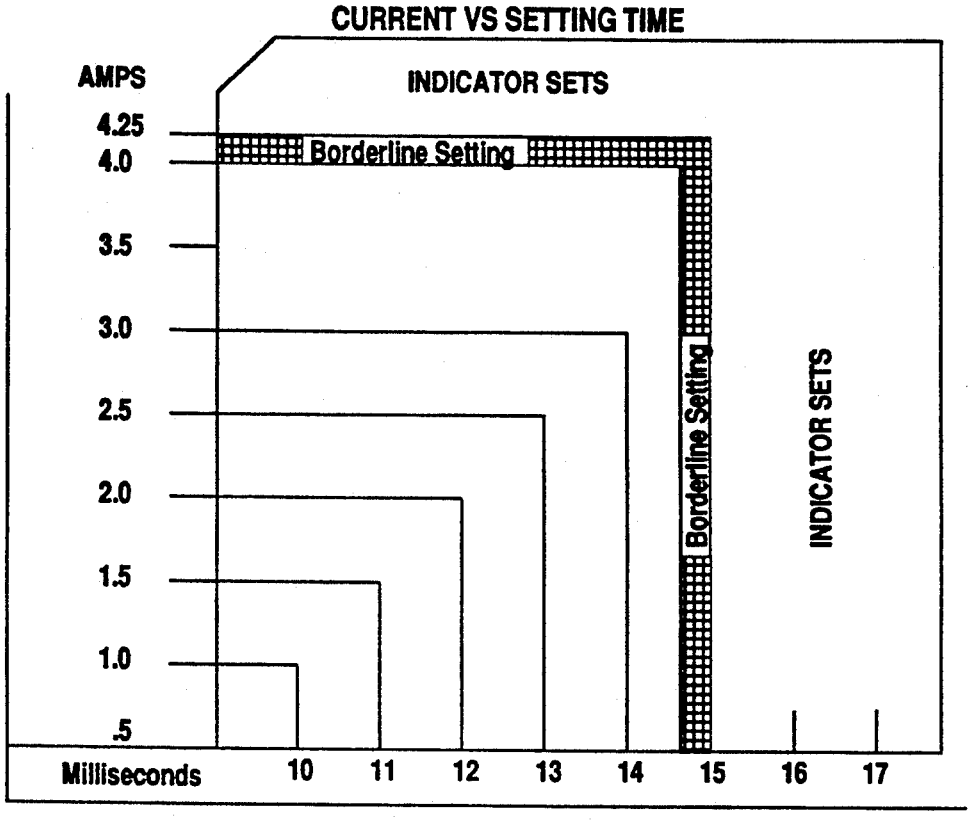
FIG. 5 is a graph showing the current and time desired for setting a magnetic indicator used in the ECM payload simulator.

FIG. 5 is a graph showing typical currents and times desired for setting a magnetic indicator used in an ECM payload simulator of the present invention. The magnetic indicator should be set by the minimum pulse required to fire an ECM payload device such as the ALE-45 which has a firing pulse duration of approximately 22 ms and an amplitude of approximately 4.25 VDC. To assure typical magnetic indicator sets with desired voltages and time durations, referring back to FIG. 4, a series threshold adjusting resistor 20 is connected between the firing pin 16 and magnetic indicator 6 with a resistance value to assure the magnetic indicator sets with a 15 ms minimum firing pulse of about 4.25 AMPS.

The housing and electrical components described so far for a single payload ECM payload simulator do not take into account the weight of an actual pyrotechnic ECM payload device, and this should be done. Thus, the weight of an RR 170 Chaff Cartridge is 5.5 oz, so to increase the weight of the ECM payload simulator for such a cartridge, additional compound material is added to increase the weight to 5.5 oz. An example of such a compound material is insulating Flexane 94 TM.

Figure 6:
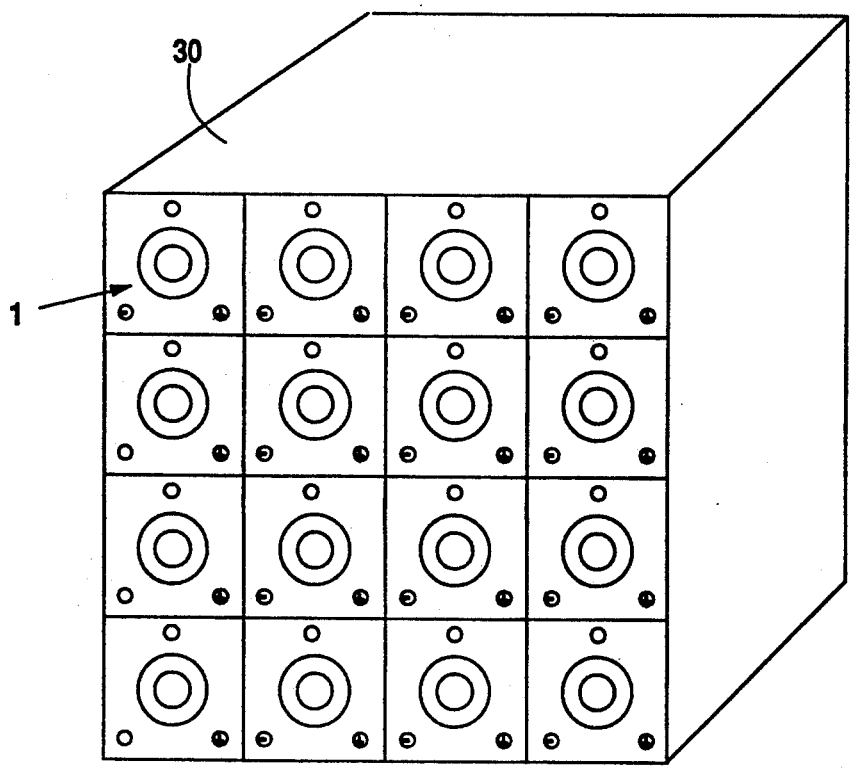
FIG. 6 shows a magazine containing multiple single payload ECM payload simulators.

FIG. 6 shows a typical magazine or pod 30 containing multiple single payload ECM payload simulators such as the ECM payload simulator 1 of FIG. 1. Since the ECM payload simulator of the present invention uses the housing of an actual ECM payload device and connects to the firing and ground pins of a squib just as an actual ECM payload device does, the ECM payload simulator 1 can be installed into a typical ECM magazine or pod.

Figure 7:
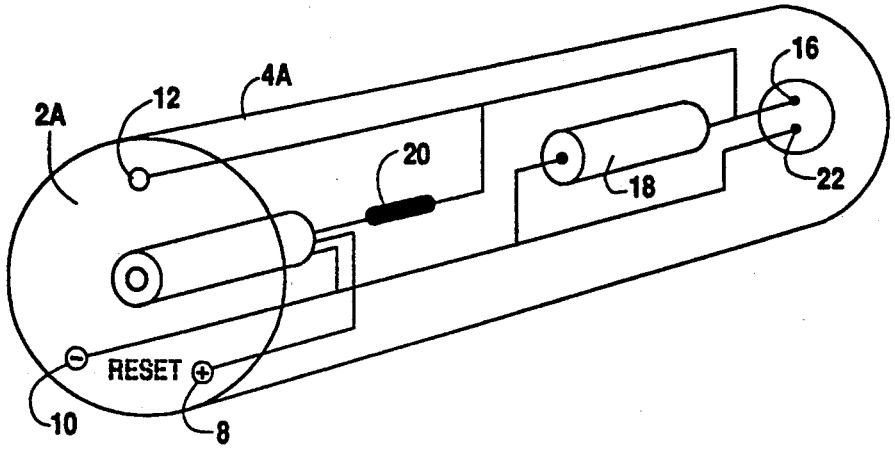
FIG. 7 shows another embodiment of an ECM payload simulator similar to FIG. 1, but using components from an AN/ALE-29 payload device.

FIG. 7 shows an alternate embodiment of an ECM payload simulator similar to FIG. 1, but using components from an AN/ALE-29 payload device, enabling simulation of the AN/ALE-29 payload device. The ECM payload simulator of FIG. 7 includes the liner cartridge 4A from an AN/ALE-29 payload device. The ECM payload simulator of FIG. 7 also includes the cartridge end cap 2A from an AN/ALE-29 payload device. The remaining components shown in FIG. 7 necessary for an ECM payload simulator which are the same as components from FIG. 1 are labeled the same. Creation of additional ECM payload simulators capable of simulating other actual ECM payload devices may also be accomplished by substituting the liner cartridge, cartridge end cap, and other components.

Figure 8:
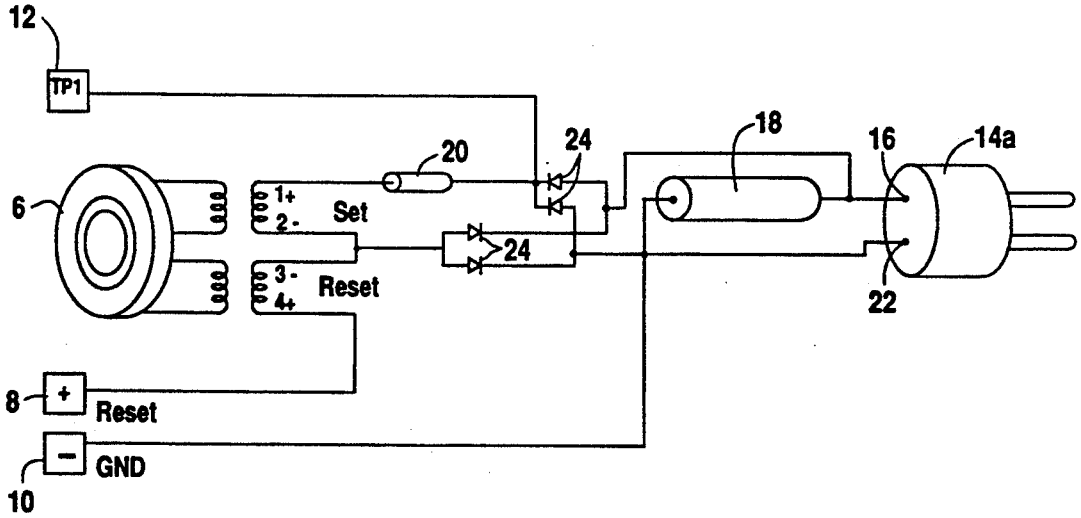
FIG. 8 shows a more detailed circuit diagram for the electrical components contained in the ECM payload simulator of FIG. 7.

FIG. 8 shows a more detailed circuit diagram for the electrical components contained in the ECM payload simulator of FIG. 7. Just as in FIG. 7, FIG. 8 shows that components from various actual payload devices can be substituted or added to create ECM payload simulators capable of simulating these various actual payload devices. As shown in FIG. 8, the inert squib 14A has been substituted from an AN/ALE-29 payload device. Additionally, diodes 24 have been added to prevent feedback signals from affecting the ECM payload dispensing system. The remaining components shown in FIG. 8 necessary for an ECM payload simulator which are the same as components from FIG. 4 are labeled the same.

Figure 9:
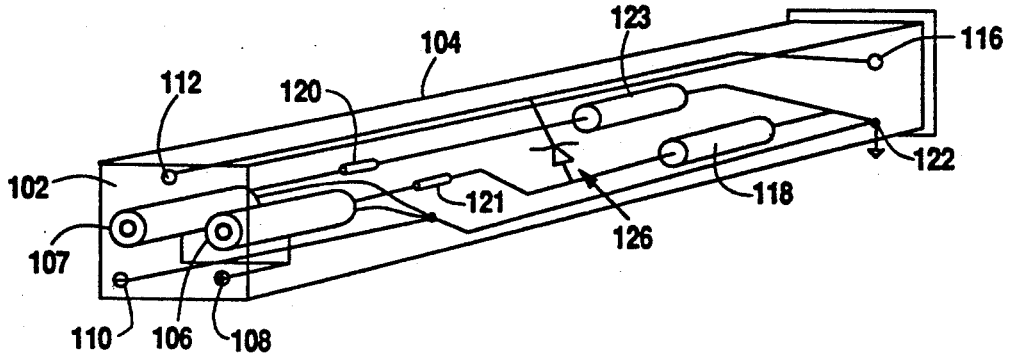
FIG. 9 shows another embodiment of the present invention, a dual payload ECM payload simulator.

FIG. 9 shows another embodiment of the present invention, a dual payload ECM payload simulator. Such a dual payload simulator, for example, can simulate the RR-180 dual chaff cartridge discussed earlier. Similar to the single payload simulator of FIG. 1, the dual payload simulator includes a housing which contains electronic components necessary to indicate accurate operation of an ECM dispensing system.

The dual payload ECM payload simulator uses a housing similar to the single payload ECM payload simulator. The dual payload ECM payload simulator housing includes a liner cartridge 104 and cartridge end cap 102. Openings in the liner cartridge 104 enable two magnetic indicators 106 and 107 to be viewed. Additional openings in the liner cartridge 104 enable resetting of the indicators through positive and negative 3 VDC contacts 108 and 110, and testing of the fire pin 116 and magnetic indicators 106 and 107 through test point 112.

Figure 10:
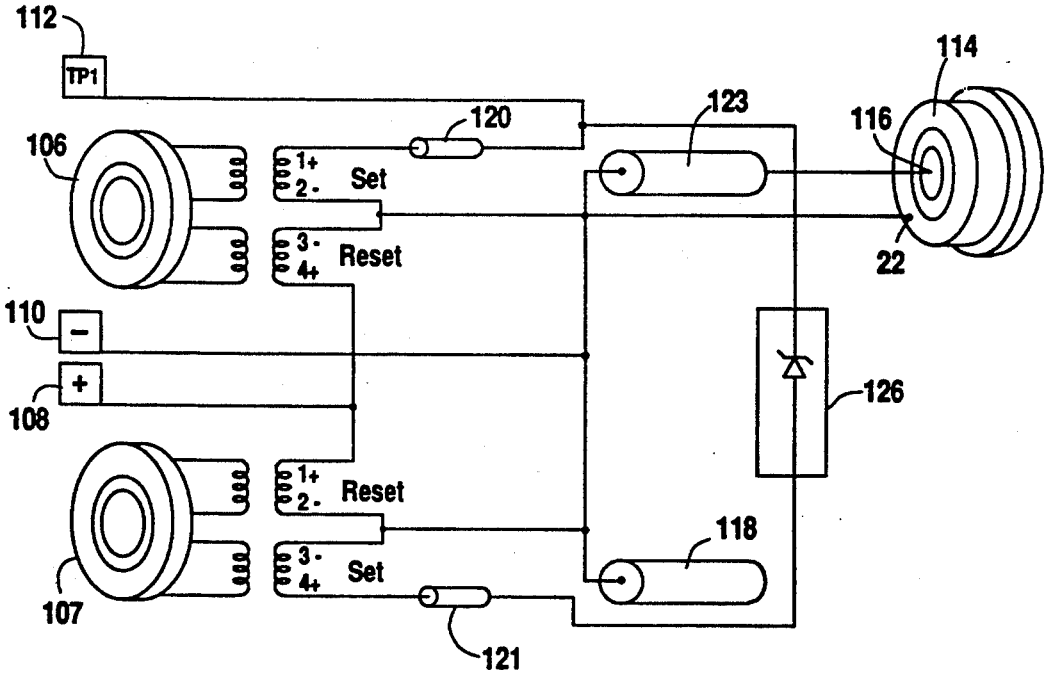
FIG. 10 shows a more detailed circuit diagram for the electrical components contained in the dual payload ECM payload simulator of FIG. 9.

FIG. 10 shows a more detailed circuit diagram for the electrical components contained in the dual payload ECM payload simulator of FIG. 9. An inert squib 114 encloses the firing pin 116 and ground spring 122. The setting circuits of magnetic indicators 106 and 107 are connected to the ground spring 122 and through threshold adjusting resistors 120 and 121 to the firing pin 116.

Since two firing pulses are emitted to fire certain dual cartridges such as the RR-180 dual chaff cartridge, a first DC voltage pulse and a second pulse of a second higher DC voltage, the circuit configuration of FIG. 9 is somewhat changed from FIG. 4. The first firing signal of an RR-180 dual cartridge is 5 VDC, so connected in parallel with magnetic indicator 107 is a 1 ohm 1% 20 Watt resistor 118 similar to the resistor of the single payload ECM payload simulator of FIG. 1. Connected in series between the fire pin 116 and 1 ohm resistor 118 is a 6.2 VDC zener voltage regulator 126 to protect against the second 12 VDC fire pulse. Connected in parallel with magnetic indicator 106 is a 2 Ohm 1% 20 Watt resistor 123 which enables the second fire pulse of 12 VDC to provide adequate current to set magnetic indicator 106, but inadequate current to set magnetic indicator 106 with a 5 VDC pulse.

Figure 11:
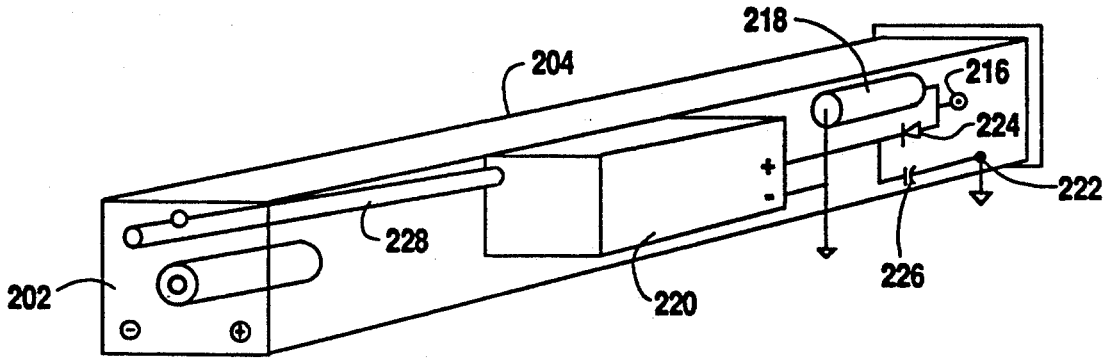
FIG. 11 shows another embodiment of the present invention which uses a radio frequency (RF) code transmitting ECM payload simulator along with the magnetic indicator used in other embodiments.

FIG. 11 shows another embodiment of the present invention which substitutes a radio frequency (RF) transmitting ECM payload simulator for the magnetic indicator used in other embodiments. The RF transmitter 220 transmits operation conditions of the firing pin 216 and ground spring 222 during flight to a ground based radar site. The RF transmitting ECM payload simulator has a housing consisting of a liner cartridge 204 and cartridge end cap 202 and mounts against fire pin 216 and ground spring 222 similar to the single and dual payload ECM payload simulators of FIG. 1 and FIG. 9.

Figure 12:
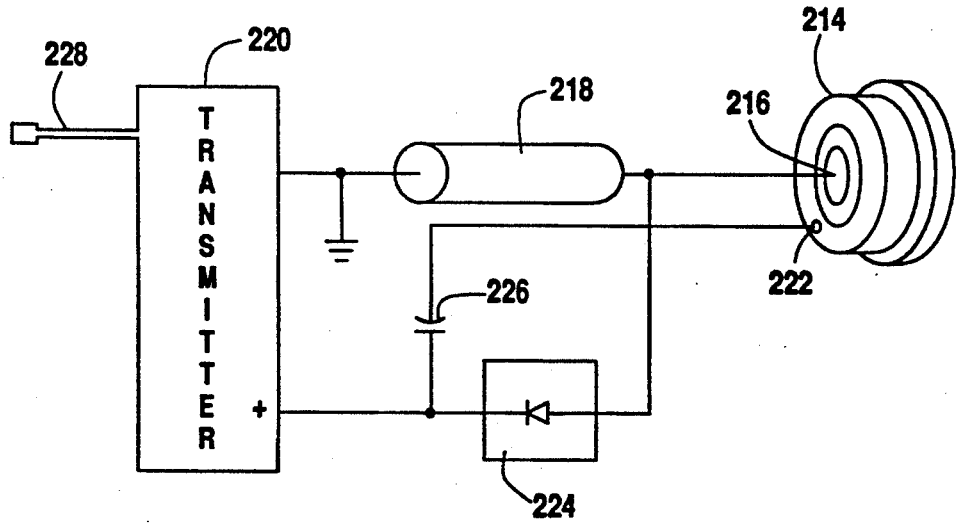
FIG. 12 shows a more detailed circuit diagram for the electrical components contained in the RF code transmitting ECM payload simulator of FIG. 11.

FIG. 12 shows a more detailed circuit diagram for the electrical components contained in the RF transmitting ECM payload simulator of FIG. 11. A 1 ohm 1% 20 Watt resistor 218 is connected from fire pin 216 to the transmitter ground connection. A voltage rectifier consisting of diode 224 and capacitor 226 connects between firing pin 216 and the positive input terminal of transmitter 220. The voltage rectifier is grounded at ground spring 222. Transmitter 220 has a RF output through coaxial cable and connector 228 extending into an opening in the liner cartridge 204. An antenna (not shown) can thus be connected to the coaxial cable and connector 228.

Figure 13:
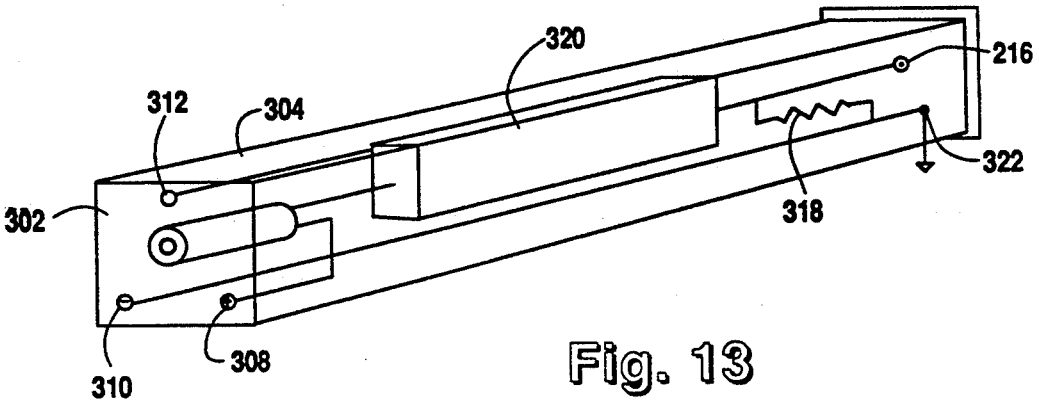
FIG. 13 shows another embodiment of the present invention which uses electronic circuitry to measure the firing pulse amplitude and duration, and to disconnect the ECM dispensing system during setting of the magnetic indicator.

FIG. 13 shows another embodiment of the present invention which uses electronic circuitry to measure the firing pulse amplitude and duration, and to disconnect the ECM dispensing system during setting of the magnetic indicator. The electronic measuring and protection circuitry 320 measures and records the amplitude and duration of the firing pulse received from firing pin 316. The electronic measuring and protection circuitry 320 disconnects the ECM dispensing system during setting of the magnetic indicator. The ECM payload simulator containing the electronic measuring and protection circuitry also has a housing consisting of a liner cartridge 304 and cartridge end cap 302 and mounts against fire pin 316 and ground spring 322 similar to the single ECM payload simulators of FIG. 1.

Figure 14:
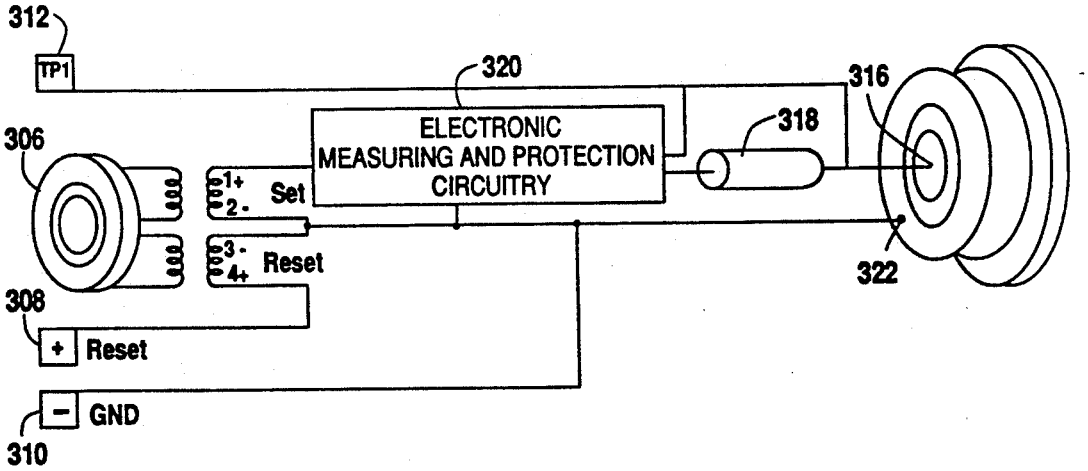
FIG. 14 shows a more detailed circuit diagram for the electrical components contained in the ECM payload simulator of FIG. 13.

FIG. 14 shows a more detailed circuit diagram for the electrical components contained in the ECM payload simulator of FIG. 13. A 1 ohm 1% 20 Watt resistor 318 is connected from fire pin 316 directly to the electronic measuring and protection circuitry. The electronic measuring and protection circuitry is connected to ground spring 322, the set circuitry of the magnetic indicator 306 and test point 312. Positive and negative 3 VDC contact points 308 and 310 enable resetting of the magnetic indicator 306.

Although the invention has been described above with particularity, this was merely to teach one of ordinary skill in the art how to make and use the invention. Many modifications will fall within the scope of the invention, as that scope is defined by the following claims.

What is claimed is:

1. An electronic countermeasure payload simulator for use with an electronic countermeasure dispensing system which generates an electrical signal to dispense countermeasures from an electronic countermeasure payload device, said electronic countermeasure payload simulator comprising:

a housing capable of be installed on an aircraft;

a first magnetic indicator housed by said housing capable of detecting application of the electrical signal generated by the electronic countermeasure dispensing system; and an electrical circuit to apply the electrical signal generated by the electronic countermeasure dispensing system to the first magnetic indicator instead of the electronic countermeasure payload device.

2. An electronic countermeasure payload simulator as claimed in claim 1 wherein the electronic countermeasure payload device has a housing which is substantially identical to the housing of the electronic countermeasure payload simulator.

3. An electronic countermeasure payload simulator as claimed in claim 1, wherein said magnetic indicator is powered exclusively by said electrical signal.

4. An electronic countermeasure payload simulator as claimed in claim 1 wherein said first magnetic indicator changes color upon the application of an electrical signal capable of firing the countermeasure payload device.

5. An electronic countermeasure payload simulator as claimed in claim 1 further comprising a resistor in parallel with said first magnetic indicator, said resistor having a resistance value set to cause an inventorying apparatus to indicate an undispensed electronic countermeasure payload device.

6. An electronic countermeasure payload simulator as claimed in claim 4 wherein said first magnetic indicator is resettable.

7. An electronic countermeasure payload simulator as claimed in claim 4 further comprising a test point connected to the first magnetic indicator enabling testing of the first magnetic indicator.

8. An electronic countermeasure payload simulator as claimed in claim 1 further comprising a first calibration resistor in series with said first magnetic indicator, said first calibration resistor value chosen to cause said first magnetic indicator to set when a current amplitude required to fire the electronic countermeasure payload device is applied.

9. An electronic countermeasure payload simulator as claimed in claim 8 further comprising:

a second magnetic indicator, and a second calibration resistor connected to said second magnetic indicator to require a higher voltage to set than said first magnetic indicator.

10. An electronic countermeasure payload simulator as claimed in claim 1 further comprising an RF transmitter for sending coded transmissions to a radar site.

11. An electronic countermeasure payload simulator as claimed in claim 1 further comprising an electronic measuring circuit which measures and records the amplitude and duration of the electrical signal generated by the electronic countermeasure dispensing system.

12. An electronic countermeasure payload simulator as claimed in claim 1 further comprising an electronic protection circuit which prevents feedback of signals to the electronic countermeasures dispensing system.

13. An electronic countermeasure payload simulator as claimed in claim 1 further comprising a filler material housed by said housing, said filler material added to make the weight of said electronic countermeasure payload simulator substantially equivalent to the electronic countermeasure payload device.

14. A method for simulating an electronic countermeasure payload device comprising the steps of:

housing electrical components, including a magnetic indicator, in a housing capable of being installed on an aircraft;

receiving an electrical signal during flight of an aircraft using said electrical components, said electrical components not dispensing anything substantially capable of achieving countermeasures, and said electrical signal generated to activate the electronic countermeasure payload device; and indicating accurate operation of said electrical signal by changing color on a magnetic indicator.

15. A method for simulating an electronic countermeasure payload device as claimed in claim 14 wherein said indicating step includes transmitting a signal from an RF transmitter to a ground based receiver.

16. A method for simulating an electronic countermeasure payload device as claimed in claim 14 further comprising the step of resetting said magnetic indicator.

17. A method for simulating an electronic countermeasure device as claimed in claim 14 further comprising the step of testing operation of said magnetic indicator and said electrical signal used to activate and electronic countermeasure payload device using a test point.

18. A method for simulating an actual airborne electronic countermeasure payload device wherein the actual payload device fires countermeasures from an aircraft in response to a firing signal generated by an electronic countermeasures dispensing system which senses energy of detection and homing systems homing on the aircraft, said method comprising the steps of:

receiving in a housing on the aircraft the firing signal; said housing simulating a housing of the actual payload device; and applying the firing signal to a magnetic indicator used in place of the countermeasures, said magnetic indicator being capable of providing a record of the firing signal whenever the firing signal fulfills signal parameters required to fire the actual payload device.

* * * * *

UNITED STATES PATENT AND TRADEMARK OFFICE

CERTIFICATE OF CORRECTION

PATENT NO. : 5,198,612

DATED : March 30, 1993

INVENTOR(S) : Thomas R. Myers

It is certified that error appears in the above-identified patent and that said Letters Patent is hereby corrected as shown below:

Column 7, line 3 (claim 1) between "of" and "installed" change "be" to --being--.

Column 8, line 37 (claim 17) between "activate" and "electronic" delete "and" and change to --an--.

Signed and Sealed this

Fourteenth Day of December, 1993

*Attest:*

Bruce Lehman

BRUCE LEHMAN

*Attesting Officer*

*Commissioner of Patents and Trademarks*